US007513495B2

(12) United States Patent
Mo

(10) Patent No.: US 7,513,495 B2
(45) Date of Patent: Apr. 7, 2009

(54) SEPARATOR

(75) Inventor: Jiangxiao Mo, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 367 days.

(21) Appl. No.: 11/301,444

(22) Filed: Dec. 13, 2005

(65) Prior Publication Data

US 2007/0132172 A1 Jun. 14, 2007

(51) Int. Cl.
*B65H 3/52* (2006.01)

(52) U.S. Cl. ..... 271/121; 271/167

(58) Field of Classification Search ..... 271/121, 271/167

See application file for complete search history.

(56) References Cited

U.S. PATENT DOCUMENTS

| | | | | |
|---|---|---|---|---|
| 5,114,134 | A | 5/1992 | Rasmussen et al. | |
| 5,116,034 | A | 5/1992 | Trask et al. | |
| 5,269,506 | A | 12/1993 | Olson et al. | |
| 5,316,285 | A | 5/1994 | Olson et al. | |
| 5,537,227 | A | 7/1996 | Samii et al. | |
| 5,549,289 | A | 8/1996 | Sonnenburg et al. | |
| 5,553,842 | A | 9/1996 | Wilcox et al. | |
| 5,570,876 | A | 11/1996 | Samii | |
| 5,615,874 | A | 4/1997 | Parthasarathy et al. | |
| 5,655,762 | A | 8/1997 | Yergenson | |
| 5,764,384 | A | 6/1998 | Wilcox et al. | |
| 5,882,004 | A | 3/1999 | Padget | |
| 5,947,466 | A | 9/1999 | Romine | |
| 6,009,302 | A | 12/1999 | Worley et al. | |
| 6,082,729 | A | 7/2000 | Padget | |
| 6,135,444 | A | 10/2000 | Padget | |
| 6,151,140 | A | 11/2000 | Wilcox et al. | |
| 6,257,569 | B1 | 7/2001 | Rhodes et al. | |
| 6,315,282 | B2 | 11/2001 | Chua et al. | |
| 6,322,065 | B1 | 11/2001 | Underwood et al. | |
| 6,433,897 | B1 | 8/2002 | Wilcox et al. | |
| 6,523,820 | B2 | 2/2003 | Gustafson et al. | |
| 6,536,757 | B2 * | 3/2003 | Chang | 271/16 |
| 6,637,743 | B2 | 10/2003 | Underwood et al. | |
| 6,651,973 | B2 | 11/2003 | Gaarder et al. | |
| 6,663,098 | B2 | 12/2003 | Teo et al. | |
| 6,716,254 | B2 * | 4/2004 | Takeuchi | 271/167 |
| 6,764,072 | B2 | 7/2004 | Gaarder | |
| 6,866,259 | B2 | 3/2005 | Underwood et al. | |
| 6,874,779 | B2 * | 4/2005 | Park | 271/121 |
| 6,932,529 | B2 | 8/2005 | Richtsmeier et al. | |
| 7,036,814 | B2 * | 5/2006 | Oh et al. | 271/121 |
| 2003/0038419 | A1 | 2/2003 | Kawai et al. | |

OTHER PUBLICATIONS

*Milling Cutter Nomenclature—A written and pictorial definition of the basic nomenclature of a milling cutter*, New Concepts in Milling Handbook 1973 Niagara Cutter Inc., printed from internet Nov. 9, 2005, www.niagaracutter.com/techinfo/millhandbook/nomenclature (3 pages).

*Tooth Type*, Morse Industrial Band Saws, printed from internet Nov. 9, 2005, www.independenceband.com/tooth_type (2 pages).

*About Blades*, Bandsaw Blade Geometry, printed from internet Nov. 9, 2005, www.harrisonsaw.co.uk/blades/geo.asp (3 pages).

*Glossary of Saw Terminology*, Online Reference of Disston Saws—Glossary of Saw Terms, printed from internet Nov. 9, 2005 www.disstonianinstitute.com/glossary (4 pages).

* cited by examiner

*Primary Examiner*—Kaitlin S Joerger

(57) ABSTRACT

Various embodiments of a separator are disclosed.

23 Claims, 4 Drawing Sheets

FIG. 1
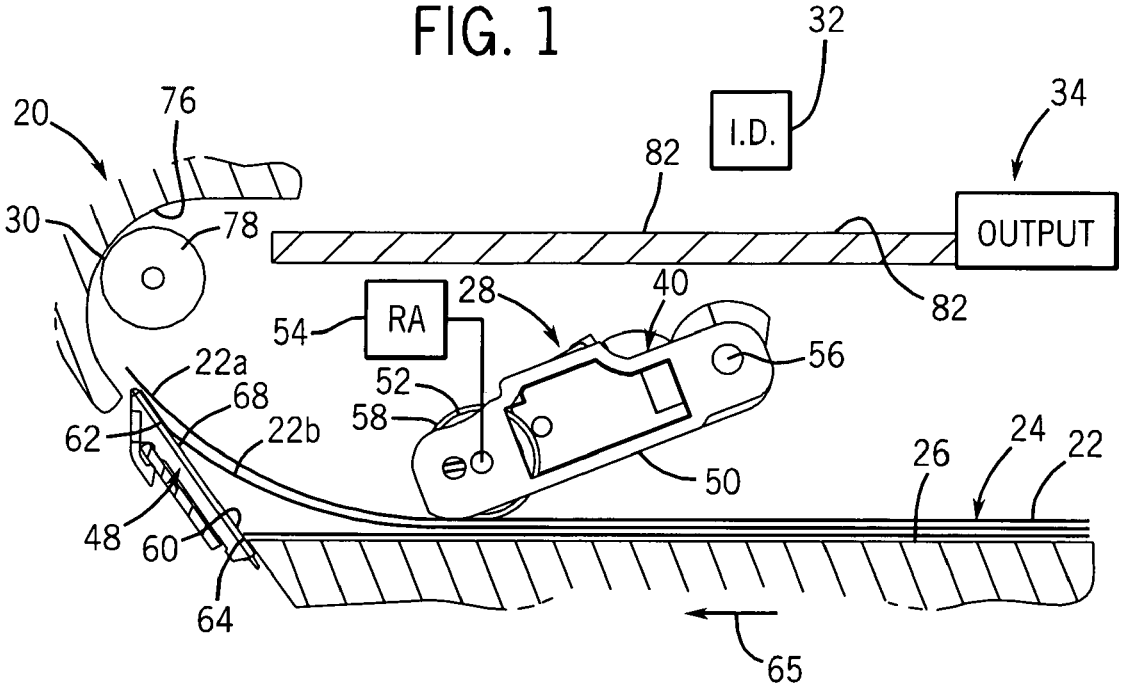
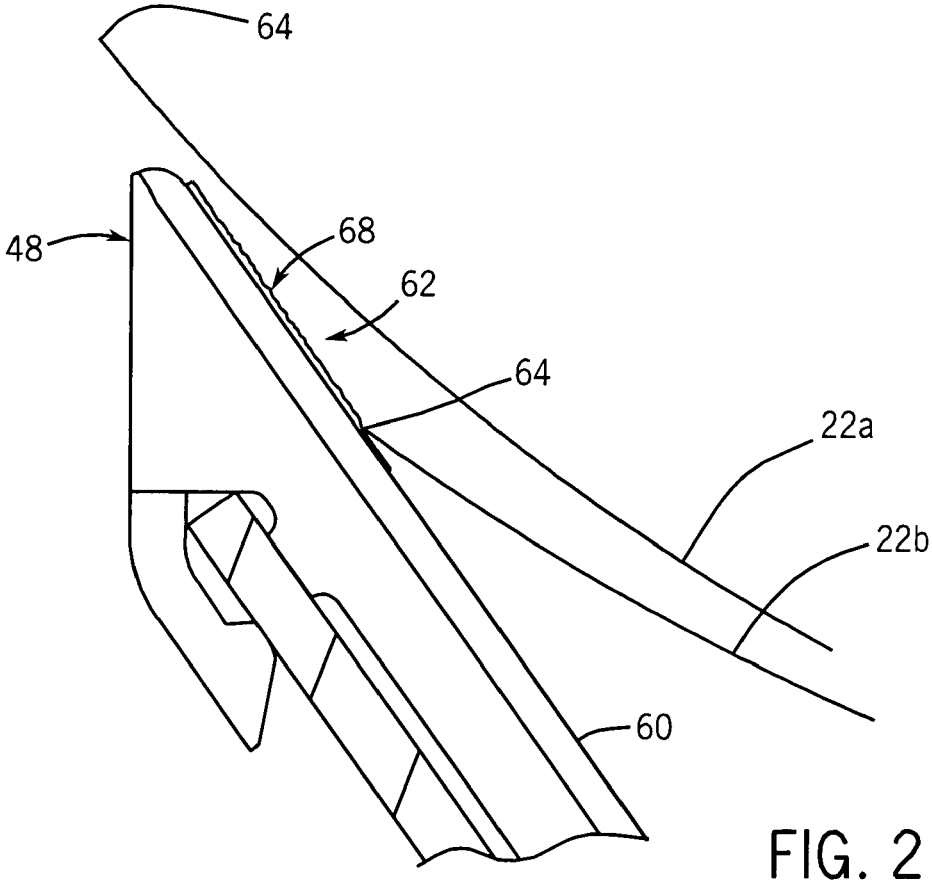
FIG. 2

SEPARATOR

BACKGROUND

In some media interaction systems, such as printers, copiers and scanners, sheets of media are sometimes fed from a stack. During feeding, multiple sheets may sometimes not separate, causing jams and other media handling errors.

BRIEF DESCRIPTION OF THE DRAWINGS

FIG. 1 is a side elevational view schematically illustrating one example of a media interaction system according to an example embodiment.

FIG. 2 is an enlarged fragmentary side elevational view of the system of FIG. 1 illustrating separation of sheets according to an example embodiment.

DETAILED DESCRIPTION OF EXAMPLE EMBODIMENTS

Figure 3:
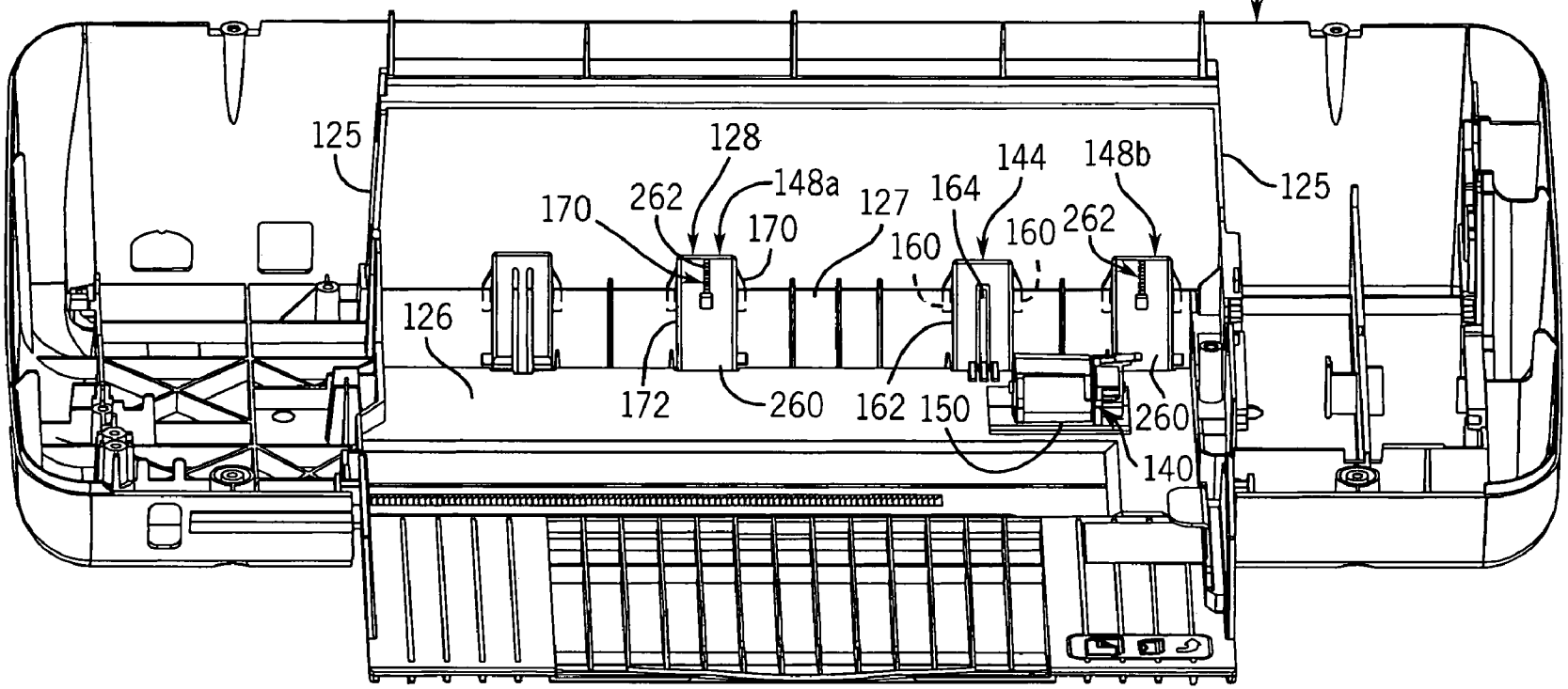
FIG. 3 is a front perspective view of another embodiment of the media interaction system of FIG. 1 according to an example embodiment.

FIG. 1 schematically illustrates one example of a media interaction system 20 configured to interact with individual sheets 22 of media provided from a stack 24 of such sheets 22. As will be described in detail hereafter, media interaction system may be less prone to media handling errors caused by multi-picks and mispicks of individual sheets 22. Media interaction system 20 generally includes media support surface 26, media pick system 28, media path 30, interaction device 32 and output 34. Media support surface 26 comprises one or more structures or surfaces configured to support stack 24 of media sheets 22. In one embodiment, media support surface 26 may be provided as part of a fixed tray, a removable tray, a bin or other platform upon which stack 24 may rest. Although media support surface 26 is illustrated as having a substantially horizontal orientation, in other embodiments, media support surface 26 may be inclined or declined.

Media pick system 28 comprises an arrangement of components configured to pick a top or outermost sheet 22 of stack 24 and to move the picked sheet towards and into media path 30. Media pick system 28 includes pick device 40 and separator 48. Pick device 40 comprises a device generally extending opposite to media support surface 26 and configured to engage one or more outermost or topmost sheets 22 from stack 24 and to move such sheets 22 towards and along separator 48. In the particular example illustrated, the media pick device includes arm 50, roller 52 and rotary actuator 54. Arm 50 comprises an elongate structure configured to pivot about axis 56 while rotatably supporting roller 52. Roller 52 comprises a cylindrical member having an outer circumferential surface 58 in frictional engagement with the top or outermost sheet 22*a* of stack 24. Rotary actuator 54 (schematically shown) comprises a device, such as a motor, operably coupled to roller 52 so as to rotatably drive roller 52 to move sheet 22*a* towards and along separator 48. In other embodiments, pick device 40 may comprise other devices or structures configured to engage and move sheets 22 from stack 24.

As shown by FIGS. 1 and 2, underlying adjacent sheet 22*b* may also adhere to sheet 22*a* and can also be moved from stack 24 towards separator 48 and towards media path 30. Separator 48 comprises an apparatus configured to facilitate separation of sheets 22*a* and 22*b* so as to permit sheet 22*a* to be moved further along media path 30, avoiding a mispick (i.e., when no sheets 22 are picked), and to inhibit further movement of sheet 22*b* along media path 30 so as to avoid a multi-pick (i.e., when more than one sheet is picked). Separator 48 includes surfaces 60 and 62.

Surface 60 extends along a face of separator 48 generally nonparallel to media support surface 26. Surface 60 is located so as to engage, contact or abut leading edges 64 of sheets 22 when sheets 22 are fully moved along surface 26 in the direction indicated by arrow 65 as a result of manual force or as a result of force applied by pick device 40 prior to bending of sheets 22 along surface 60 and while sheets 22 remain substantially parallel with support surface 26. In the particular example illustrated, surface 60 extends at an obtuse angle with respect to media support surface 26 such that leading edges 64 of sheets 22 of stack 24 are staggered or fanned along surface 60 to enhance subsequent separation of such sheets. In one embodiment, surface 60 is inclined at an angle of at least about 45 degrees and less than 90 degrees such that surface 60 is angularly spaced from media support surface 26 greater than 90 degrees and less than or equal to about 105 degrees. In one embodiment, surface 60 is angularly spaced from media support surface 26 by 120 degrees. In still other embodiments, surface 60 may be angularly spaced from media support surface 26 by other angles.

Surface 60 is configured to have a lower coefficient of friction with leading edges 64 of sheets 22 as compared to surface 62. In one embodiment, surface 60 is not as rough as surface 62. Surface 60 is configured such that leading edge 64 of sheet 22*a* and potentially sheet 22*b*, ride up surface 60 under the force applied by pick device 40 until such leading edges encounter surface 62. In other embodiments, surface 60 may alternatively include other surface irregularities. In other embodiments, surface 60 may be smooth or may be roughened while being formed from a compressible or elastomeric material to facilitate separation of sheet 22*a* from a remainder of stack 24.

Surface 62 comprises a surface along a face of separator 48 generally beyond surface 60 configured to contact and engage leading edge 64 of sheet 22*a* and potentially sheet 22*b* after such sheets 22*a* and 22*b* have been moved along surface 60 and have been bent with respect to media support surface 26 and stack 24 as a result of force applied by media pick device 40. Surface 62 is configured to permit the topmost or outermost sheet 22*a* being driven by media pick device 40 to overcome the friction provided by surface 62 so as to move across surface 62 and into media path 30. At the same time, however, surface 62 is configured to sufficiently impede or obstruct further movement of sheet 22*b*. In particular, surface 62 is configured so as to have a coefficient of friction with leading edges 64 that is greater than the coefficient of friction between sheets 22*a* and 22*b*. At the same time, surface 62 has a coefficient of friction with leading edges 64 sufficiently small enough such that the force applied to sheet 22*a* directly by pick device 40 is large enough to overcome the friction between surface 62 and leading edge 64 of sheet 22*a*, permitting sheet 22*a* to be moved to media path 30.

As further shown by FIGS. 1 and 2, according to one example embodiment, surface 62 includes surface irregularities 68 (schematically shown) which provides surface 62 with a coefficient of friction with leading edges 64 of sheets 22 that is greater than the coefficient of friction between sheets 22. In one embodiment, surface irregularities 68 may comprise one or more teeth along surface 62. In other embodiments, surface irregularities 68 may comprise roughened areas, grooves, dimples, serrations or other surface treatments configured to enhance the degree of coefficient of friction that a surface has with respect to another surface such as leading edges 64 of sheets 22. In yet other embodiments, surface 62 may omit surface irregularities 68 where surface 62 is formed from a material distinct from that of surface 60 and having a coefficient of friction with leading edges 64 of sheets 22 that is greater than the coefficient of friction between sheet 22*a* and the underlying sheet 22*b*.

Media path 30 comprises a passage along which sheets 22 of media picked by pick system 28 travel to interaction device 32. In the particular example illustrated, media path 30 is formed by guide surface 76, roller 78 and platen 82. Guide surface 76 comprises a surface against which sheet 22 is moved. Roller 78 comprises a roller rotatably driven to drive media along guide surface 76. In other embodiments, media path 30 may be formed by other structures including other guide surfaces, additional rollers, belts or other arrangements configured to move media from media support surface 26 to interaction device 32.

Platen 82 comprises a surface configured to support media opposite to interaction device 32 as the media is interacted upon. Although platen 82 is illustrated as being horizontal and media guide surface 76 is illustrated as being arcuate, in other embodiments, media guide surface 76 and platen 82 may have other orientations and other shapes. In particular embodiments, platen 82 may be omitted.

Media interaction device 32 comprises a device configured to interact with a face of a sheet 22 generally positioned opposite to interaction device 32. In one embodiment, media interaction device 32 may comprise a printhead configured to eject fluid ink or other fluid material upon sheet 22. Examples of such printheads include thermoresistive printheads. In still other embodiments, media interaction device 32 may be configured to deposit toner or other printing material upon a face of a sheet 22. In yet other embodiments, media interaction device 32 may comprise a device configured to scan or read information, data, patterns and the like from the face of a sheet 22. In yet other embodiments, media interaction device 32 may be configured to interact with a sheet 22 of media in other fashions.

Output 34, schematically shown, comprises a tray, bin or other structure configured to receive sheets 22 once they have been interacted upon by interaction device 32. In one embodiment, output 34 may comprise a tray, bin and the like configured to store and provide a person access to interacted upon sheets. In yet other embodiments, output 34 may comprise other devices or mechanisms configured to further manipulate such sheets such as a duplexer and the like.

In operation, a stack of media is placed upon media support surface 26, wherein each of the sheets 22 of stack 24 extend substantially parallel to one another and parallel to media support surface 26. Arm 50 supports surface 58 of roller 52 in engagement with the top or outermost sheet 22*a*. Rotary actuator 54 rotatably drives roller 52 which is in frictional engagement with sheet 22*a*. As a result, pick device 40 drives sheet 22*a* along surface 60 away from a remainder of stack 24. During such movement, sheet 22*a* is bent and becomes non-parallel with respect to media support surface 26 and stack 24. Because the coefficient of friction between leading edge 64 and surface 62 is less than the coefficient of friction between surface 58 of roller 52 and sheet 22*a*, rotation of roller 52 by rotary actuator 54 moves leading edge 64 of sheet 22*a* across surface 62 and into media path 30. Thereafter, roller 78 drives sheet 22*a* against guide surface 76 and across platen 82. Media interaction device 32 interacts with sheet 22*a*. Upon being interacted upon, sheet 22*a* is further driven to output 34.

During movement of sheet 22*a*, sheet 22*b* may also move as a result of its adherence to sheet 22*a* caused in part by the coefficient of friction between sheets 22*a* and 22*b*. As a result, sheet 22*b* may also move upward along surface 60 away from the remainder of stack 24 and away from media support surface 26. Because surface 62 has a coefficient of friction with respect to leading edge 64 of sheet 22*b* that is greater than the coefficient of friction between sheets 22*a* and 22*b*, surface 62 holds or retains sheet 22*b* against further movement while sheet 22*a* is moved by pick device 40 relative to sheet 22*a*. As a result, surface 62 of separator 48 reduces the likelihood that sheet 22*b* will undesirably be moved into media path 30 along with sheet 22*a*. Consequently, the likelihood of a multi-pick is reduced.

Figure 4:
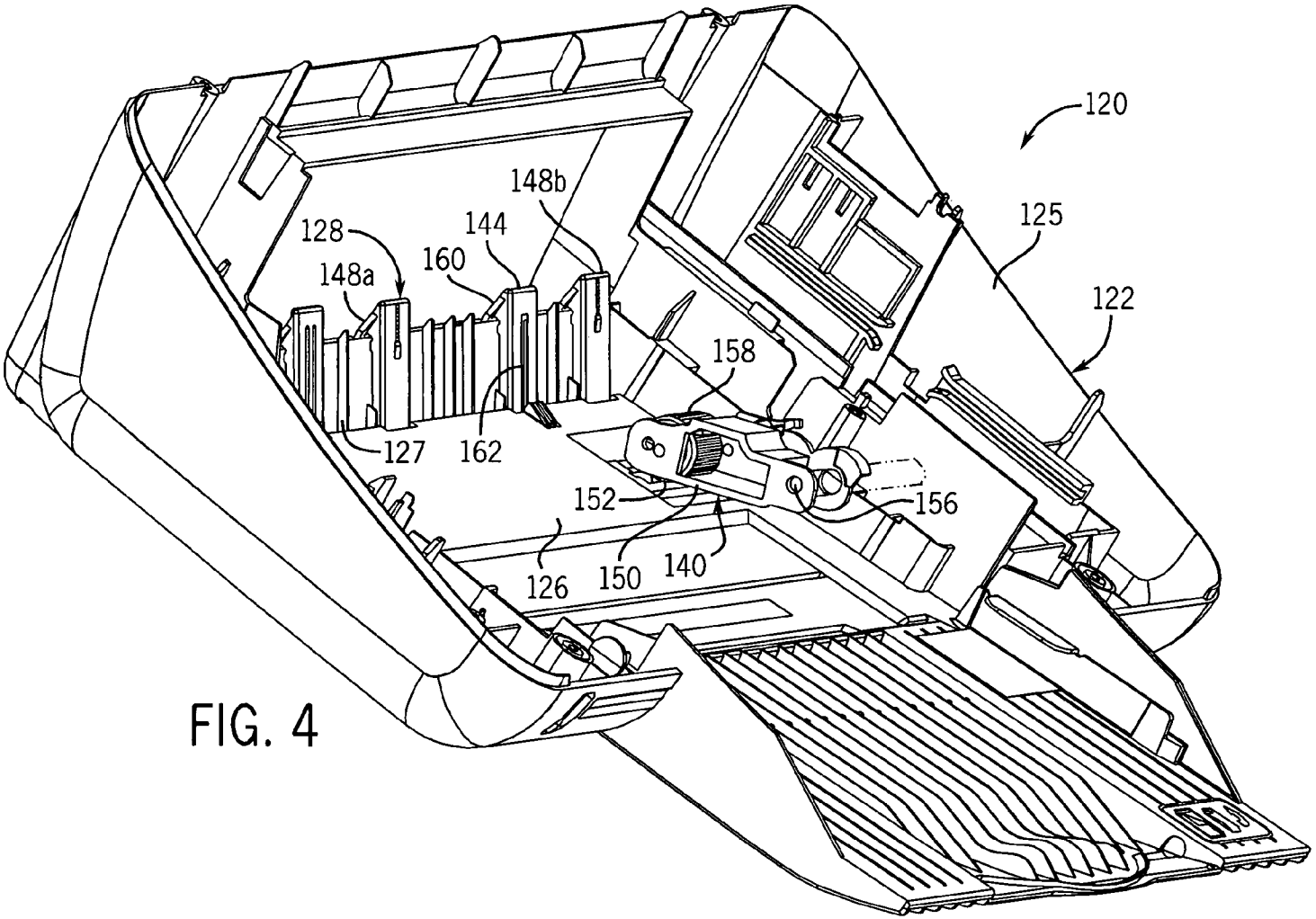
FIG. 4 is a perspective sectional view of the system of FIG. 3 taken along line 4-4 according to an example embodiment.

FIGS. 3 and 4 illustrate media interaction system 120, a particular embodiment of media interaction system 20 shown in FIG. 1. As shown by FIGS. 3 and 4, media interaction system 120 includes frame 122, media support surface 126 and media pick system 128. Media interaction system 120 additionally includes media path 30, media interaction device 32 and output 34 shown and described with respect to FIG. 1. Frame 122 comprises one or more structures configured to support media pick system 128. In one embodiment, frame 122 may additionally be configured to guide insertion of a stack of media into engagement with media pick system 128. As shown by FIG. 4, frame 122 generally projects upwardly from media support surface 126 and includes sides 125 and separator support 127. Sides 125 guide insertion of media into system 120 while support 127 supports portions of media pick system 128. In the particular example illustrated, sides 125 and separator support 127 are integrally formed as part of a single unitary body with one another and with media support surface 126. In other embodiments, sides 125 and separator support 127 may alternatively be fastened, bonded, glued, welded or otherwise coupled to one another in other fashions. In other embodiments, frame 122 may have other configurations.

Media support surface 126 comprises a surface configured to support a stack of media in position with respect to media pick system 128. Although media support surface 126 is illustrated as being substantially horizontal, in other embodiments, media support surface 126 may alternatively be inclined. Although media support surface 126 is illustrated as having various contours such as various projections and depressions, in other embodiments, media support surface 126 may alternatively be substantially flat.

Media pick system 128 comprises a device configured to pick an uppermost sheet from a stack of sheets resting upon media support surface 126. Media pick system 128 generally includes media pick device 140, media separator 144 and media separators 148*a* and 148*b* (collectively referred to as media separators 148). Media pick device 140 comprises a device configured to engage and apply force to a top or outermost sheet of a stack of media supported by media support surface 126. Media pick device 140 includes arm 150, pick roller 152 and rotary actuator 54 (shown and described with respect to FIG. 1). Arm 150 comprises an elongate structure configured to pivot about axis 156 while rotatably supporting roller 152. Arm 150 pivotally supports roller 152 about axis 156 to enable roller 152 to accommodate different stack thicknesses.

Roller 152 comprises a generally cylindrical member configured to engage the top or outermost sheet. Roller 152 is operably coupled to rotary actuator 54 (shown in FIG. 1) so as to be rotatably driven and so as to transmit force to the top or outermost sheet of the stack of media. In the particular embodiment illustrated, roller 152 has an outer surface 158 configured to frictionally engage a top or outermost sheet of media to transfer force to the media. In one embodiment, surface 158 comprises an elastomeric material such as a natural or synthetic rubber. In still other embodiments, surface 158 may be formed from other materials or may be configured to transfer force to the top or outermost sheet of media in other fashions.

Media separator 144 facilitates separation of the top or outermost sheet being driven by media pick device 140 from any underlying sheets of the stack of media. Media separator 144 generally includes arms 160, body 162 and separator surface 164. Arms 160 project from body 162 behind separator support 127 to removably mount separator 144 to separator support 127. As a result, separator 144 may be removed and repositioned at various locations along separator support 127 to accommodate differently sized media sheets. In other embodiments, separator 144 may be integrally formed or permanently bonded, fastened, adhered or welded to separator support 127.

Body 162 comprises a structure extending from arms 160 and supporting separator surface 164. In other embodiments, body 162 may alternatively be integrally formed as part of a single unitary body with separator support 127 or may be fastened, welded or bonded to separator support 127.

Surface 164 comprises one or more members having a surface configured to have a coefficient of friction with a leading edge of sheets of media sufficiently high to facilitate separation of a top or outermost sheet of media from underlying sheets of media resting upon media support surface 126, yet low enough to allow the top or outermost sheet of media to be moved by media pick device 140 along surface 164. Surface 164 is supported by body 162 and generally extends from media support surface 126 to a location spaced from media support surface 126 such that surface 164 contacts the leading edge of each sheet of the largest or thickest stack of media for which pick system 128 and frame 122 may accommodate. In one embodiment, surface 164 has a linear length of about 22 mm for the media stack height up to 10 mm. In some other embodiment, the surface 164 has a linear length of about 40 mm for the media stack height up to 30 mm. In one embodiment, surface 164 is formed from an elastomeric or compressible material such as a natural or synthetic rubber. In other embodiments, other elastomeric compressible materials may be employed. In yet other embodiments, surface 164 may be roughened, dimpled, textured or the like to provide a desired coefficient of friction with the leading edges of sheets of media in a stack. In the particular example illustrated, surface 164 comprises an elongate strip of such material extending along a front face of body 162 and having a width of at least about 2 mm and nominally 2.5 mm. In other embodiments, surface 164 may have other widths or dimensions.

In certain instances, despite the presence of separator 144, pick device 140 may move multiple sheets up and-along separator 144. This may be the result of an underlying sheet adhering to the sheet being directly driven by media pick device 140. Separators 148*a* and 148*b* serve as a safeguard to further facilitate separation of such sheets and to reduce the likelihood that multiple sheets will be moved into media path 30 or across media interaction device 32 (shown in FIG. 1). Because media pick system 128 includes multiple separators 148, separators 148 engage an underlying sheet at multiple locations, enhancing the effectiveness of separators 148. In the particular example illustrated, separators 148*a* and 148*b* are located on opposite sides of separator 144 and are substantially identical to one another. Because separators 148*a* and 148*b* are located on opposite sides of separator 144, separators 148 have satisfactory separation capability. In other embodiments, separators 148*a* and 148*b* may be dissimilar from one another and may be located on one side of separator 144. Although media pick system 128 is illustrated as including two separators 148, in other embodiments, media pick system 128 may include a single separator 148 or greater than two separators 148.

Figure 5:
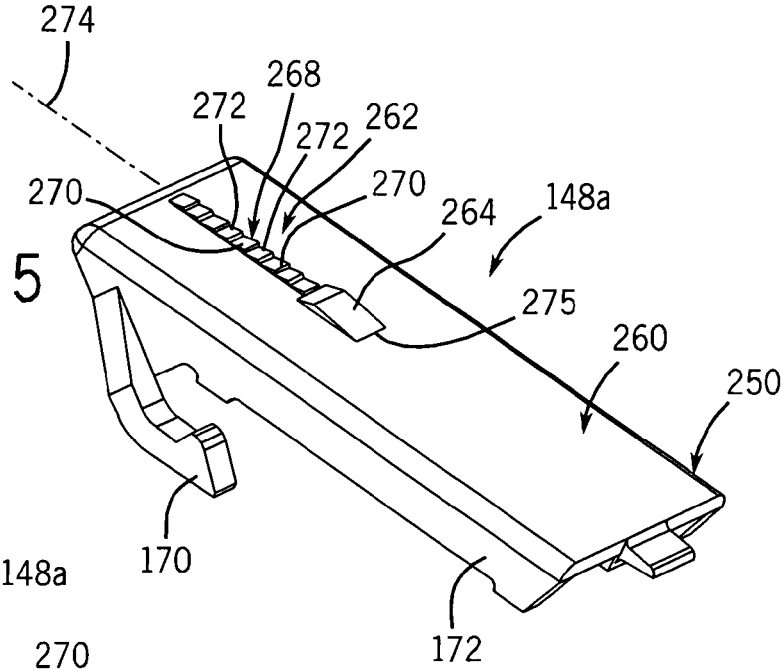
FIG. 5 is an enlarged perspective view of the separator of the system of FIG. 3 according to an example embodiment.
Figure 6:
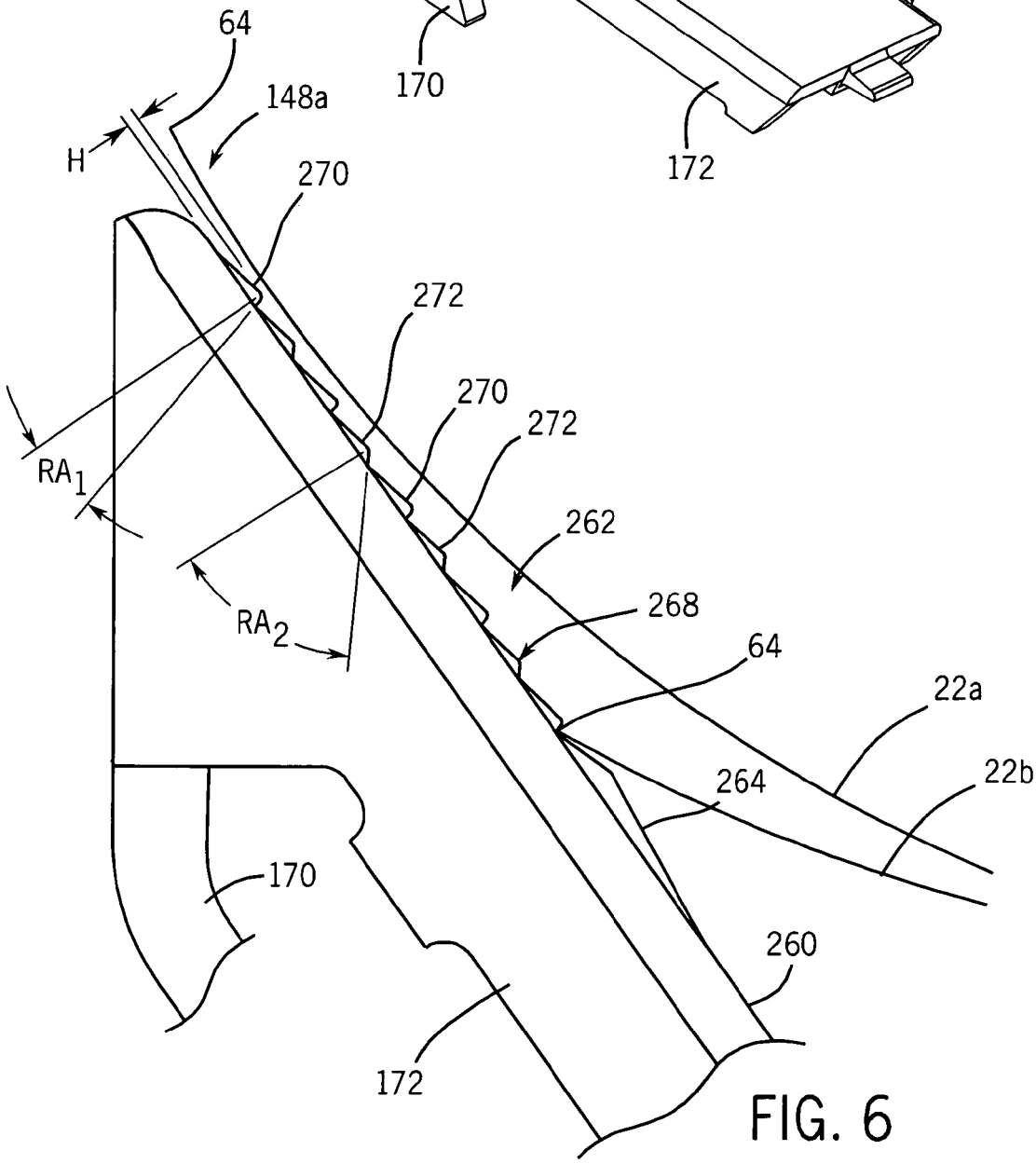
FIG. 6 is an enlarged side elevational view of the separator of FIG. 5 according to an example embodiment.

FIG. 5 is an enlarged perspective view illustrating separator 148*a* in more detail. FIG. 6 is an enlarged side elevational view of separator 148*a*. As shown by FIG. 5, separator 148*a* generally includes arms 170 and body 172 (both of which are shown in FIG. 3). Arms 170 project from body 172 and are configured to removably-mount body 172 to separator support 127. As a result, separator 148*a* may be removed and repositioned at various locations along separator support 127 to accommodate differently sized media sheets. In other embodiments, separator 148*a* may be integrally formed as a single unitary body with separator support 127 or permanently bonded, fastened, adhered or welded to separator support 127.

Body 172 comprises one or more structures configured to extend from arms 170 in front or on top of separator support 127. Body 172 has a face 250 which includes surface 260, ramp 261 and surface 262. Surface 260 comprises that portion of face 250 of separator 148*a* configured to abut leading edges of media sheets while the sheets remain substantially parallel to media support surface 126 and prior to such sheets being moved and bent away from media support surface 126 by media pick device 140 (shown in FIG. 4). Surface 260 is configured to have a lower coefficient of friction with the leading edges of sheets as compared to surface 162 of separator 144. Like surface 164, surface 260 of separator 148*a* extends from media support surface 126 a distance (measured in a direction normal to media support surface 126) greater than or equal to a maximum stack thickness for which media pick system 120 is designed to accommodate. As a result, surface 260 elevates or spaces ramp 261 and surface 262 above any stack of media held by media support surface 126. Because surface 262 is spaced above a stack of media resting upon media support surface 126, surface 262 does not contact the leading edges of media prior to the leading edge of the media being advanced by media pick device 140. Consequently, surface 262 is less likely to overly inhibit movement of the sheets of media and is less likely to cause mispicks (instances where no sheets of media are picked). In the example embodiment illustrated in FIGS. 3, 4 and 5, surface 260 extends along axis 274 a sufficient distance such that a lower end 275 of ramp 261 is spaced at least about 2 millimeters along surface 260 and along axis 274 from a top or outermost sheet of a stack of media resting upon media support surface 126 prior to portions of the top or outermost sheet being moved away from the remaining stack along separator 148*a*. In other embodiments, surface 260 of separator 148*a* may have other dimensions.

Surface 262 comprises a surface configured to have a coefficient of friction with the leading edges of sheets of media that is less than the coefficient of friction between surface 158 of roller 152 and a topmost sheet of media engaged by surface 158 and that is greater than the coefficient of friction between the topmost sheet of media and an underlying sheet of media. In the particular example illustrated, surface 262 includes surface irregularities 268 which provide surface 262 with its coefficient of friction characteristic. In the particular example illustrated, surface irregularities 268 include teeth 270 and teeth 272.

Teeth 270 and 272 comprise teeth extending along face 250 configured to engage leading edges of sheets after such sheets have been moved past surface 260 by media pick device 140 (shown in FIG. 4). Teeth 270 and 272 provide surface 260 to have a coefficient of friction with the leading edges 64 of sheets 22 being bent along face 250 that is less than the coefficient of friction between surface 258 of roller 152 and the topmost sheet of media engaged by surface 158 and that is greater than the coefficient of friction between the topmost sheet of media and the underlying sheet of media. In the particular embodiment illustrated, teeth 270 and 272 each have a height H greater than the corresponding height of surface irregularities, if any, of surface 260. For example, if surface 260 is smooth, surface 260 has surface irregularities with an effective height of 0. In one embodiment, the height H of each of teeth 270, 272 is greater than or equal to a thickness of an individual sheet 22. In one embodiment in which media interaction system 20 is configured to interact with different media sheets having thicknesses ranging from a minimum sheet thickness to a maximum sheet thickness, teeth 270 and 272 have a height H greater than or equal to the maximum sheet thickness that may be accommodated by media interaction system 20. In one embodiment, teeth 270 and 272 have a height H of at least about 0.15 millimeters. In other embodiments, teeth 270 and 272 may have other heights. Although teeth 270 and 272 are illustrated as having a common height, in other embodiments, teeth 270 and 272 may have distinct heights H.

As further shown by FIG. 6, teeth 270 and 272 each have negative rake angles RA. In other words, the front faces of teeth 270 and 272 form obtuse angles with respect to the trailing side of an adjacent tooth. The rake angles of teeth 270 and 272 impact the coefficient of friction between such teeth and the leading edge 64 of an engaged sheet 22. In the particular example illustrated, teeth 270 have a first angle $RA_1$ while teeth 272 have a second larger negative rake angle $RA_2$. As a result, teeth 270 and 272 apply different levels of resistance to movement of a sheet 22 along surface 62. Consequently, surface 62 may better accommodate different sheets 22 of media having different thicknesses and/or material properties, causing such different sheets to have different levels of coefficient of friction with respect to teeth 270 and 272. In one embodiment, teeth 270 have a rake angle of between about 13 degrees and 17 degrees and nominally 15 degrees while teeth 272 have a rake angle $RA_2$ of between about 48 degrees and 52 degrees and nominally about 50 degrees. In other embodiments, teeth 270 and 272 may have other rake angles. In the particular example illustrated, teeth 270 and 272 are alternately repeated across surface 62. In other embodiments, surface 62 may alternatively omit teeth 270, omit teeth 272 or may include other teeth configurations.

Teeth 270 and 272 have a pitch (number of teeth per inch) sufficiently large so as to minimize the likelihood of a sheet undesirably skipping such teeth yet sufficiently small to facilitate engagement by the leading edge of such teeth with the leading edge 64 of a sheet 22. In the embodiment illustrated, teeth 270 and 272 have a pitch of at least about 11 per inch, or less than or equal to about 15 per inch and nominally about 13 per inch. In still other embodiments, teeth 270 and 272 may have other pitches. Although teeth 270 and 272 are illustrated as having a substantially uniform pitch, in other embodiments, teeth 270 and 272 may have a nonuniform pitch. Although teeth 270 and 272 are illustrated as having a substantially uniform gullet (the notch or cavity between consecutive teeth) depth, in other embodiments, teeth 270 and 272 may have a varying or nonuniform gullet depth.

Ramp 264 extends between surface 260 and surface irregularities 268 of surface 262. Ramp 264 provides an inclined surface against which leading edges 64 of sheets ride to a height above or beyond a height of surface irregularities 268. The inclined surface of ramp 264 engages leading edges of sheets so as to cause such sheets to buckle. Upon reaching the end of ramp 264, such buckled sheets, which are in tension, snap back into engagement with surface irregularities 268, facilitating secure contact between surface irregularities 268 and the leading edge of such sheets 22. In other embodiments, ramp 264 may be omitted.

Overall, like media interaction system 20, media interaction system 120 facilitates separation of a top or outermost sheet from a stack of sheets. Surface 262 provides a safeguard in those instances in which separator 144 has failed to adequately separate the top or outermost sheet from underlying sheets. Surface irregularities 268 provide separator 148*a* and 148*b* with an appropriate coefficient of friction with leading edges of sheets being moved along separators 148*a* and 148*b* to permit the topmost sheet to be moved while obstructing further movement of an engaged underlying sheet. Because surface irregularities 268 includes distinct teeth, separators 148*a* and 148*b* may accommodate different types of media sheets which may have different coefficients of friction with respect to a single tooth 270 or a single tooth 272. As a result, separators 148*a* and 148*b* reduce the likelihood of a mispick in which no sheets are separated from a stack and a multi-pick in which more than one sheet is separated from a stack.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A separator comprising:

a first surface configured to engage edges of sheets extending parallel to a media support surface and having a first coefficient of friction with the edges of the sheets;

a second surface configured to engage edges of sheets that extend nonparallel to a media support surface while being driven by a pick device, wherein the second surface has a second greater coefficient of friction with the edges of the sheets, wherein the second surface includes surface irregularities comprising teeth having rake angles, the teeth including a first tooth having a first negative rake angle and a second tooth having a second larger negative rake angle, wherein the first surface and the second surface are inclined; and a ramp between the first surface and the second surface and rising above the teeth.

2. The separator of claim 1, wherein the teeth have a height of at least about 0.15 millimeters.

3. The separator of claim 1, wherein the separator is configured to separate multi-picks of sheets having a thickness and wherein the teeth have a height greater than the thickness.

4. An apparatus comprising:

a first surface configured to engage the edges of sheets in a stack prior to movement by a pick device; and a second surface configured to engage the edges of the sheets during movement by the pick device, wherein the second surface includes surface irregularities comprising teeth, wherein the teeth include a first tooth having a first negative rake angle and a second tooth having a second larger negative rake angle and wherein the first tooth and the second tooth alternately repeat along the second surface.

5. a The apparatus of claim 4, wherein the first surface and the second surface are inclined.

6. The apparatus of claim 4 further comprising a media stack storage configured to store a maximum stack thickness of media and wherein the surface irregularities are beyond the maximum stack thickness.

7. The apparatus of claim 4, wherein the teeth have a height of at least about 0.15 millimeters.

8. The apparatus of claim 4 further comprising a ramp between the first surface and the second surface.

9. The apparatus of claim 8, wherein the ramp has a height greater than a height of the teeth.

10. The apparatus of claim 4 further comprising a third surface configured to engage the leading edges of media prior to movement by the pick device, wherein the third surface has a higher coefficient of friction with the media than the first surface.

11. The apparatus of claim 10, wherein the third surface is elastomeric.

12. The apparatus of claim 4 further comprising a media support surface configured to support the stack of media, wherein the first surface and the second surface form a first separator that is removably coupled to the media support surface.

13. The apparatus of claim 12 further comprising:

a third surface is smooth or having third surface irregularities spaced from the first surface and configured to engage the edges of the sheets in the stack prior to movement by the pick device; and a fourth surface configured to engage the edges of the sheets during movement by the pick device, wherein the fourth surface has fourth surface irregularities having a fourth height greater than the third height.

14. The apparatus of claim 13 further comprising:

a fifth surface between the first surface and the third surface, wherein the fifth surface is configured to have a higher coefficient of friction with the edges of the media than the first surface or the third surface.

15. The apparatus of claim 4 further comprising:

a media interaction device;

a media support surface configured to support a stack of media;

a media path from the media support surface to the media interaction device; and a media pick device opposite the media support surface.

16. An apparatus comprising:

a media support surface configured to support a stack of sheets during picking from the stack of sheets; and a separator comprising an inclined surface rising above an entirety of the media support surface and having a height so as to rise above a top most sheet of the stack of sheets, the inclined surface having teeth configured to engage the leading edge of a sheet being bent by a pick device, wherein the teeth include a first tooth having a first rake angle an a second tooth having a second rake angle.

17. A method comprising:

engaging all leading edges of sheets in a stack extending parallel to a media support surface with a first surface along a first portion of an incline rising above an entirety of the media support surface and having a height so as to rise above a top most sheet of the stack of sheets, the first surface having a first coefficient of friction with the leading edges of the sheets; and engaging the leading edges of the sheets after the sheets have been moved in a direction away from the media support surface up the incline with a second surface along a second higher portion of the incline having a second greater coefficient of friction with the leading edges of the sheets.

18. An apparatus comprising:

a first surface configured to engage the edges of sheets in a stack prior to movement by a pick device;

a second surface configured to engage the edges of the sheets during movement by the pick device, wherein the second surface is rougher than the first surface and includes surface irregularities comprising teeth; and a ramp between the first surface and at the second surface, wherein the ramp has a height greater than a height of the teeth.

19. The apparatus of claim 18, wherein the first surface and the second surface are inclined.

20. The apparatus of claim 19, wherein the teeth include a first tooth having a first negative rake angle and a second tooth having a second larger negative rake angle and wherein the first tooth and the second tooth alternately repeat along the second surface.

21. The apparatus of claim 18, wherein the teeth project beyond the second surface by a first distance perpendicular to the second surface and wherein the ramp projects beyond the second surface by a second distance perpendicular to the second surface and greater than the first distance.

22. The apparatus of claim 21, wherein the teeth include a first tooth having a first negative rake angle and a second tooth having a second larger negative rake angle and wherein the first tooth and the second tooth alternately repeat along the second surface.

23. The apparatus of claim 18, wherein the teeth include a first tooth having a first negative rake angle and a second tooth having a second larger negative rake angle and wherein the first tooth and the second tooth alternately repeat along the second surface.

* * * * *

UNITED STATES PATENT AND TRADEMARK OFFICE

CERTIFICATE OF CORRECTION

PATENT NO. : 7,513,495 B2
APPLICATION NO. : 11/301444
DATED : April 7, 2009
INVENTOR(S) : Jiang-Xiao Mo It is certified that error appears in the above-identified patent and that said Letters Patent is hereby corrected as shown below:

On the Title page, in Item (75), in "Inventor", in column 1, line 1, delete "Jiangxiao Mo" and insert -- Jiang-Xiao Mo --, therefor.

In column 9, line 17, in Claim 5, delete "a" before "The apparatus".

In column 10, line 11, in Claim 16, after "angle" delete "an" and insert -- and --, therefor.

Signed and Sealed this

Twenty-fourth Day of November, 2009

David J. Kappos

David J. Kappos
*Director of the United States Patent and Trademark Office*